US008621723B2

(12) United States Patent
Meissner

(10) Patent No.: US 8,621,723 B2
(45) Date of Patent: Jan. 7, 2014

(54) RELOCATABLE ORNAMENTS AND RELATED METHODS

(76) Inventor: Callahan Meissner, Lee's Summit, MO (US)

( * ) Notice: Subject to any disclaimer, the term of this patent is extended or adjusted under 35 U.S.C. 154(b) by 180 days.

(21) Appl. No.: 13/208,223

(22) Filed: Aug. 11, 2011

(65) Prior Publication Data

US 2012/0040201 A1 Feb. 16, 2012

Related U.S. Application Data

(60) Provisional application No. 61/401,315, filed on Aug. 12, 2010.

(51) Int. Cl.

| | |
|---|---|
| ***A44B 99/00*** | (2010.01) |
| ***A42B 7/00*** | (2006.01) |
| ***A42B 1/00*** | (2006.01) |

(52) U.S. Cl.
USPC ..... 24/3.1; 63/38; 2/84; 2/410

(58) Field of Classification Search
None
See application file for complete search history.

(56) References Cited

U.S. PATENT DOCUMENTS

| | | | | |
|---|---|---|---|---|
| 4,321,804 | A * | 3/1982 | Borofsky et al. | 63/3.2 |
| 4,674,298 | A * | 6/1987 | Wimmershoff-Caplan | 24/3.13 |
| 5,912,718 | A * | 6/1999 | Murai et al. | 351/52 |
| 2003/0110798 | A1 * | 6/2003 | Ignatowski | 63/38 |
| 2005/0109059 | A1 * | 5/2005 | Alessandrino | 63/23 |

* cited by examiner

*Primary Examiner* — Jack W. Lavinder
(74) *Attorney, Agent, or Firm* — John K. Buche; Buche & Associates, P.C.

(57) ABSTRACT

Disclosed is an apparatus and related methods of differentiating an item or improving its aesthetic appearance.

10 Claims, 2 Drawing Sheets

RELOCATABLE ORNAMENTS AND RELATED METHODS

CROSS-REFERENCE TO RELATED APPLICATIONS

This application claims the priority and benefit of U.S. Prov. Pat. App. Ser. No. 61/401,315 (filed Aug. 12, 2010) and entitled "Shademates™." The cited provisional patent application is hereby incorporated by reference in its entirety.

STATEMENT REGARDING FEDERALLY SPONSORED RESEARCH OR DEVELOPMENT

Not Applicable.

BACKGROUND OF THE INVENTION

1. Field of Invention

This specification discloses relocatable (e.g., attachable and removable from a variety of locations) charms, trinkets, or other ornaments (collectively "ornaments") and related methods of use and construction.

2. Background

On occasion, populations of people simultaneously wear or possess on their respective persons items with shared characteristics. For instance, it is not uncommon for populations of people attending a sporting event to simultaneously wear sweatshirts or hoodies ("hooded sweatshirts"), wherein said sweatshirts or hoodies share characteristics (e.g., similar colors, a torso, neck hole, and sleeves). Under such circumstances, individuals within said population may be desirous of differentiating, beyond any inherently distinctive features, their personal item from the other similar items within the population. Accordingly, there is a need for apparatus and related methods of differentiating an item from other items with similar characteristics.

On other occasions, a subpopulation of people within a general population must wear or possess on their respective person items that are undesirable or anathema in appearance to the general population. For instance, some children within a group of children at a school may require vision assistance in the form of glasses, wherein the wearing of glasses has been deemed unpopular by the group. For another instance, sometimes individuals must wear clothing (e.g., shoes, sweatshirts, glasses, bags, backpacks, and the like) that is of an outdated style or of a tattered condition, wherein said style or condition may be unfavorable to society. In such circumstances, a need arises for apparatus and related methods of improving the appearance of an item.

Some proposals for meeting the above identified needs involve the attachment of an ornament to the item to be distinguished or aesthetically improved. For instance: U.S. Pat. No. 5,654,787 (issued Aug. 5, 1997), U.S. Pat. No. 4,968,128 (issued Nov. 6, 1990), U.S. Pat. No. 6,520,635 (issued Feb. 18, 2003), D376811 (issued Dec. 24, 1996), U.S. Pat. No. 7,559,655 (issued Jul. 14, 2009), U.S. Pat. No. 5,500,693 (issued Mar. 19, 1996), U.S. Pat. No. 5,161,234 (issued Nov. 3, 1992), U.S. Pat. No. 4,909,620 (issued Mar. 20, 1990), U.S. Pat. No. 4,298,991 (issued Nov. 10, 1981), U.S. Pat. No. 4,105,304 (issued Aug. 8, 1978), U.S. Pat. No. 2,682,724 (issued Jul. 6, 1954), U.S. Pat. No. 2,724,834 (issued Nov. 29, 1955), U.S. Pat. No. 2,835,063 (issued May 20, 1958), D635608 (issued Apr. 5, 2011), 589184 (issued Apr. 20, 1999), U.S. Pat. No. 4,471,509 (issued Sep. 18, 1984), U.S. Pat. No. 3,979,795 (issued Sep. 14, 1976), U.S. Pat. No. 4,927,258 (issued May 22, 1990), U.S. Pat. No. 4,974,956 (issued Dec. 4, 1990), U.S. Pat. No. 5,497,211 (issued Mar. 5, 1996), U.S. Pat. No. 5,675,988 (issued Oct. 14, 1997) (see also U.S. Pat. No. 6,027,213 (issued Feb. 22, 2000) and U.S. Pat. No. 7,322,214 (issued Jan. 29, 2008)), and D564574 (issued Mar. 18, 2008) disclose apparatus and related methods for the attachment of an ornament to the frame of eyeglasses; U.S. Pat. No. 7,698,836 (issued Apr. 20, 2010), D598314 (issued Jul. 2, 2009), and D604940 (issued Dec. 1, 2009) disclose apparatus and related methods for the attachment of an ornament to a shoe or shoe lace; D598314 (issued Jul. 2, 2009), D604940 (issued Dec. 1, 2009), D161005 (issued Nov. 28, 1950), and D343139 (issued Jan. 11, 1994) disclose apparatus and related methods for the attachment of an ornament to a scarf, tie, pull-string and the like; D630,549 (issued Jan. 11, 2011), U.S. Pat. No. 6,026,546 (issued Feb. 22, 2000), U.S. Pat. No. 5,136,758 (issued Aug. 11, 1992), U.S. Pat. No. 2,221,759 (issued Nov. 19, 1940), and U.S. Pat. No. 2,145,118 (issued Jan. 24, 1939) disclose apparatus and related methods for the attachment of an ornament to zippers; and, U.S. Pat. No. 0,301,133 (issued Jul. 1, 1884), U.S. Pat. No. 0,737,085 (issued Aug. 25, 1903), and U.S. Pat. No. 5,140,723 (issued Aug. 25, 1992) disclose apparatus and related methods for the attachment of an ornament to a writing implement or other rod-like item. Although capable of differentiating or improving the appearance of an item, such apparatus and methods for the attachment of an ornament to an item have not been entirely satisfactory since said apparatus and methods are either: (1) not universal (i.e., are limited to a specific genus of item and/or further limited to a specific species within a genus of items); or (2) feature complicated attachment mechanisms so that the ornament becomes difficult to relocate after attachment. Accordingly, there remains a need for apparatus and related methods of differentiating an item or improving the appearance of an item.

With respect to items with rod-like or string-like components, one way to somewhat universalize an ornamental apparatus for differentiating an item or improving the appearance of the item is to provide a loop or sleeve type structure for the attaching receipt of the rod or string component of the item. Examples of this type of apparatus populate the group of above recited patents. However, known loop or sleeve type structures, whether elastic or not, have not been entirely suitable for rending an ornamental apparatus universal to items with rod-like or string-like components. One unsatisfactory aspect results from rod or string like components of a genus of items varying substantially in diameter so that a universal loop or sleeve structure on an ornament attachment must be exceedingly elastic or have a complicated adjustment system to be universal. Exceedingly elastic loop or sleeve structures have yet been unpreferable in attachable ornaments since the elastic forces, when exerted, may deform the ornamental aspects of the attachment. Adjustment systems are unpreferable due to complexity. Accordingly, there remains a need for a universal apparatus and related methods of differentiating an item or improving the appearance of an item, wherein the item features rod or string like components.

SUMMARY OF THE INVENTION

In view of the foregoing, it is an object of this application to disclose an apparatus and related methods of differentiating an item or improving its aesthetic appearance. It is a further object of this application to meet the above objective with fewer drawbacks than are present in now known apparatus for the same purpose.

As a preferable means for meeting the above-recited objectives, this specification discloses, among other things, an apparatus that may comprise: (a) an ornament; (b) rigid and/or semi-rigid gasket attached to said ornament; and, (c) an elastic loop attached to said gasket. Operably, said apparatus may be applied to an item with rod-like or string like components (e.g., writing implements, zipper pull tabs, eyeglasses' temple arms, and the like) via constricting the elastic loop around one or more of said components.

BRIEF DESCRIPTION OF THE FIGURES

The manner in which these objectives and other desirable characteristics can be obtained is better explained in the following description and attached figures in which.

Figure 1:
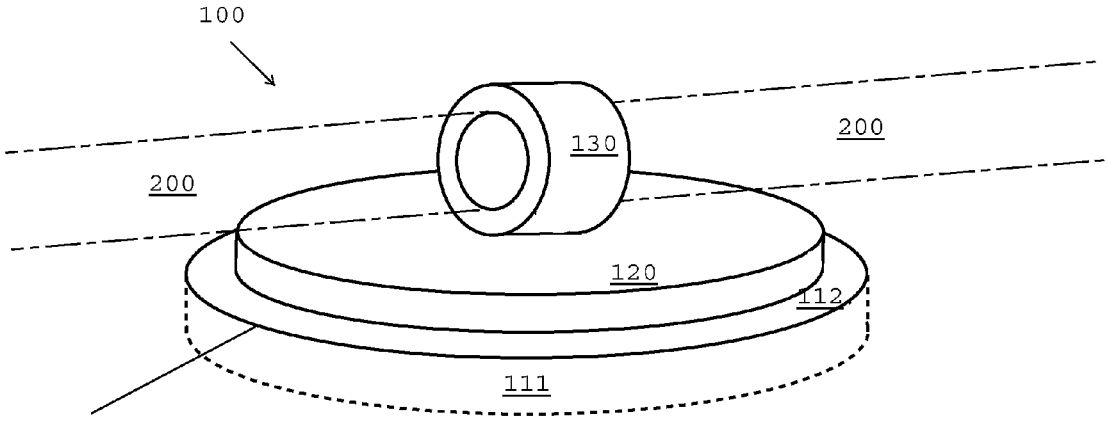
FIG. 1 is a perspective view a preferable apparatus 100.
Figure 2:
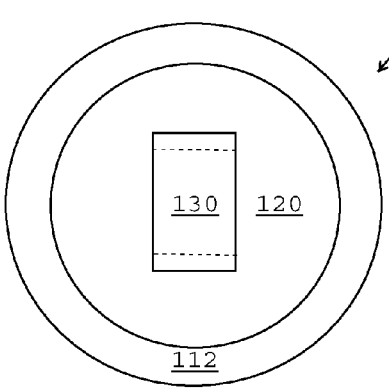
FIG. 2 is a top view of the apparatus of FIG. 1.
Figure 3:
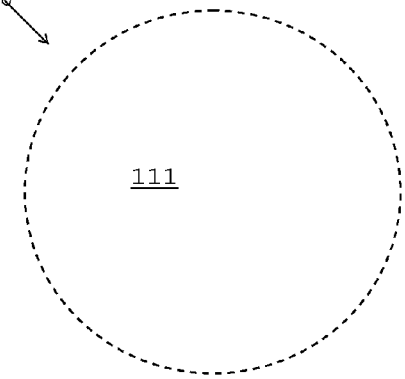
FIG. 3 is a side view of the apparatus of FIG. 1.
Figure 4:
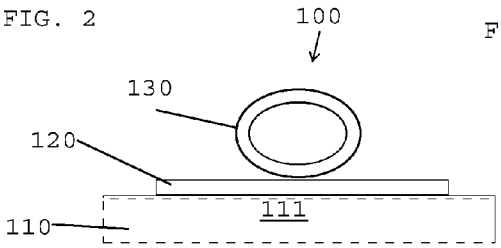
FIG. 4 is a side view of the apparatus of FIG. 1.

It is to be noted, however, that the appended figures illustrate only a typical embodiment disclosed in this application, and therefore, are not to be considered limiting of the scope of invention principles, for the invention principles disclosed herein may admit to other equally effective embodiments that will be appreciated by those reasonably skilled in the relevant arts. For instance, the components in the figures are not necessarily to scale, with an emphasis instead being placed upon illustrating the principles of the invention. In the figures, like reference numerals designate corresponding parts throughout the different views.

DETAILED DESCRIPTION OF PREFERRED EMBODIMENTS

Disclosed by this specification is a preferable embodiment of an apparatus and related methods of differentiating an item or improving its aesthetic appearance. The disclosed apparatus may feature: (a) an ornament; (b) rigid and/or semi-rigid gasket attached to said ornament; and, (c) a loop attached to said gasket. Operably, said apparatus may be applied to an item with rod-like or string like components (e.g., writing implements, zipper pull tabs, eyeglasses' temple rods, and the like) via constricting the elastic loop around one or more of said components.

FIGS. 1 through 4 respectively depict a perspective, top, side, and bottom views of an apparatus 100 attached to a component of an item 200. As seen in the figures, the depicted apparatus 100 comprise three parts: an ornament 110; a rigid and/or semi-rigid gasket 120; and a loop 130. The component 200 of the item is shown in dashed lines because the component may be of any shape or cross-sectional area.

The ornament 110 preferably features at least one ornamental surface 111 and at least one attachment surface 112. It is not necessary that the ornamental 111 and attachment 112 surfaces be distinct of one another so that, in some instances, the ornamental surface 111 and attachment surface 112 may be the same. As discussed below, the attachment surface 112 may be a location where the gasket 120 is attached to the ornament 110.

Referring still to FIGS. 1 through 4, the ornamental surface 112 of the ornament 110 is drawn in broken lines because the ornament 110 may be a structure of any ornamental appearance or design. Many preferable trinkets may define a suitable ornament, for instance any medallion, token, coin, jewel, sign or other medium may be a suitable ornament 110. In a preferable embodiment, the ornament 110 may be a medallion with the logo of a sports team (e.g., the Los Angeles Lakers) or image of a cartoon character (e.g., Mickey Mouse). In many instances, the ornament 110 may preferably feature any image, logo, design, emblem or insignia.

Structurally, the ornament 110 may be flexible or rigid. Accordingly, the materials suitable for constructing the ornament 110 include, but are not limited to, metals, woods, plastics, fabrics, textiles, ceramics, rocks, jewels, composites and the like. Those of skill in the art will know well how to form the ornament 110 depending on the material of construction. In a preferable embodiment, the ornament is plastic that has been molded into a medallion in the shape of a sports team logo or cartoon character (e.g., in the same manner of construction as the ornamental feature of the apparatus disclosed in U.S. Pat. No. 7,698,836 (issued Apr. 20, 2010), D598314 (issued Jul. 2, 2009), and D604940 (issued Dec. 1, 2009)).

The gasket 120 is preferably an intermediate structure between the loop 130 and the ornament 110. As discussed in further detail below, the loop 130 may preferably feature elastic properties and the gasket 120 is intermediate to the loop 130 and ornament 120 so the ornament 120 is protected against deformation by said elastic properties. If the ornament 120 is sufficiently rigid, then the gasket 120 may be bypassed so that the ornament 120 and loop 130 are attached directly. Those of skill in the art will be able to readily determine whether the materials composing the ornament 110 require an intermediate gasket 120 to prevent such deformation. When used, the gasket 120 may be of any shape and any rigid and/or semi-rigid material. In a preferable embodiment, the gasket 120 is a rigid (and/or semi-rigid) plastic or metallic disk.

Referring once again to FIGS. 1 through 4, the ornament 110 may be mechanically attached to the rigid and/or semi-rigid gasket 120 at its attachment surface 112. The attachment may be (a) rigid or manipulable and (b) permanent or temporary. For instance, the gasket may be adhesively bonded (via an epoxy or other resin) to the ornament 110 to accomplish a rigid and permanent attachment. For another instance, the attachment may be via hook and loop fasteners (e.g., Velcro) for a rigid and temporary attachment. In another instance, the attachment may be a swiveling snap fit connection for a rigid or temporary and manipulable attachment. In a preferable embodiment, the ornament 120 is rigidly adhered to the gasket 120 via an epoxy, resin, or other compatible adhesive (e.g., superglue) (Please note that adhesives and epoxies utilized should preferably compatible with both the material of the gasket 120 and the ornament 110 and those of skill in the art will be readily able to ascertain an appropriate adhesive given the composition of the ornament 110 and the gasket 130).

The loop 120 is preferably an elastic yet semi-rigid structure attached to the gasket 120 or attachment surface 112 of the ornament 110. Since the loop 130 may contact various components of an item to which the apparatus 100 is attached, the loop may preferably be composed of a non-skid material. In a preferable embodiment the loop 130 is rubber constructed via known methods of constructing rubber tubes. The loop 130 may mechanically attach to the ornament 110 or gasket 120 in a manner that is similar to the above described attachment of the gasket 120 to the ornament 110 (e.g., the attachment may be (a) rigid or manipulable and (b) permanent or temporary). In a preferable embodiment the loop 130 is attached to the gasket 120 or ornament 110 via superglue, a similar epoxy, or other compatible adhesive.

Operably, the depicted apparatus 100 may be applied to an item with rod-like or string-like components (e.g., writing implements, zipper pull tabs, eyeglasses' temple rods, and the like) via first stretching and then constricting the elastic loop around one or more of said components 200. Accordingly, the apparatus 100 should be sized to cooperate with the item to which the apparatus 100 will be attached. In a preferable embodiment the loop 130 is a rubber tube that has been sized so that the apparatus 100 may be attached in one instance to the pull-strings of a hoody, in another instance to a writing implement, in yet another instance to the pull tab of a zipper, in other instances to shoe laces, and in a final instance to an arm of a glasses' frame via constricting the loop 130 around one or more of said components. FIGS. 1 through 4 illustrate use of the apparatus 100 in the various instances. In a preferable embodiment, the loop 130 is a rubber tube of one-fourth inch diameter and is capable of constricting a shoe lace, an arm of a glasses frame that is one-eighth inch this by one inch tall, and standard writing implements of up to an inch in diameter.

Figure 5:
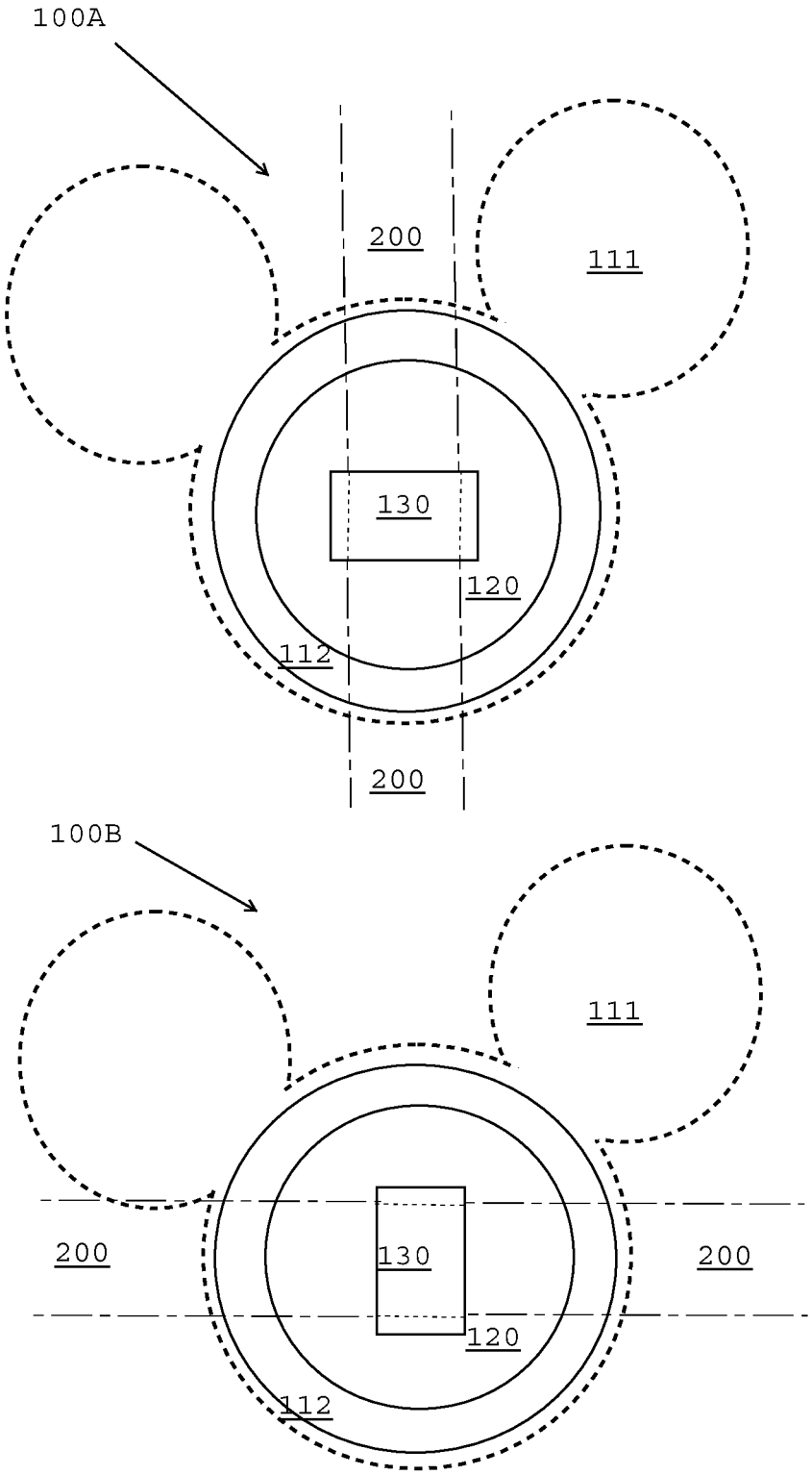
FIG. 5 is a comparative view of two apparatus 100A and 100B.

FIG. 5 is a comparison of two apparatus 100A and 100B that are different with respect to the orientation of the ornament 120 relative to the axis of the loop 130 (and correspondingly the component 200 of the item to which the apparatus 100A and 100B is attached). In the figure, the ornament is the face of a cartoon mouse. The preferable orientation of the mouse apparatus 100A and 100*b* relative to the loop 130 will change depending on the item to which it is attached. For example, it may be preferable to have the mouse positioned perpendicular relative to the axis of the loop 130 when the apparatus 100A is placed on an arm of a glasses' frame, whereas it may be preferable to have the mouse positioned parallel relative to the axis of the loop 130 when the apparatus 100B is placed on a zipper pull tab. Different orientations may be accomplished in a single apparatus via incorporating a swivel mechanism into the attachments of the gasket 120 or loop 130 to the ornament 110. In preferable embodiments the orientation is set and permanent. Although disclosed with reference to ornament 110 orientations that are parallel and perpendicular to the loop axis, it will be readily apparent to those of skill in the art that any orientation of the ornament 110 that is oblique to the axis of the loop 130 will also be preferable.

The intent of this specification is to provide apparatus for temporarily or long-term attachment of an ornament to a structure or item. The foregoing description of implementations has been presented for purposes of illustration and description. It is not exhaustive and does not limit the claimed inventions to the precise form disclosed. Modifications and variations are possible in light of the above description or may be acquired from practicing the invention. The claims and their equivalents define the scope of the invention.

These aspects, among other things, demonstrate the industrial applicability of this invention.

Moreover, it should be apparent that further numerous structural modifications and adaptations may be resorted to without departing from the scope and fair meaning of the present invention as set forth hereinabove and as described herein below by the claims.

I claim:

1. A method of altering the appearance of an item comprising the steps of:

obtaining an apparatus comprising an ornament connected to an elastic loop;

deforming the elastic loop;

inserting a component of the item into the deformed loop; and, constricting the loop around said component, wherein the item is a hooded sweatshirt and the component is a pull string thereof.

2. The method of claim 1 wherein the item is an eyeglasses frame and the component is an arm thereof.

3. The method of claim 1 wherein the item is a writing implement and the component is a shaft thereof.

4. The method of claim 1 wherein the item is a show and a component is a string thereof.

5. The method of claim 1 further comprising the step of orienting the ornament perpendicular to the component of the item.

6. The method of claim 1 further comprising the step of orienting the ornament parallel to the component of the item.

7. The method of claim 1 further comprising the step of orienting the ornament oblique to the component of the item.

8. A method of altering the appearance of an item comprising the steps of:

securing a loop to an ornament;

stretching the loop;

inserting a component of the item into the loop;

constricting the loop around the component; further comprising the steps of:

stretching the loop;

removing the component from the loop;

placing a second component of a second item into the loop;

constricting the loop around the second component;

wherein the first component is a string and the second item is selected from the group consisting essentially of a writing implement, eyeglasses's frame, and a zipper's pull tab.

9. The method of claim 8 wherein the component is a string.

10. The method of claim 8 wherein the first item is an eyeglasses frame and the second item is selected from the group consisting essentially of a writing implement, a hooded sweatshirt, a shoe, or a zipper's pull tab.

* * * * *